United States Patent [19]

Inukai

[11] Patent Number: 4,724,358

[45] Date of Patent: Feb. 9, 1988

[54] HIGH-PRESSURE METAL VAPOR ARC LAMP LIT BY DIRECT CURRENT POWER SUPPLY

[75] Inventor: Shinji Inukai, Yokohama, Japan

[73] Assignee: Kabushiki Kaisha Toshiba, Kawasaki, Japan

[21] Appl. No.: 896,958

[22] Filed: Aug. 15, 1986

[30] Foreign Application Priority Data

Aug. 28, 1985 [JP] Japan ..... 60-187385

[51] Int. Cl.[4] ..... H01J 17/04; H01J 61/06; H01J 17/20; H01J 61/20

[52] U.S. Cl. ..... 313/628; 313/632; 313/642

[58] Field of Search ..... 313/631, 632, 634, 627, 313/628, 638, 643, 642; 315/206, 207

[56] References Cited

U.S. PATENT DOCUMENTS 4,387,319 6/1983 White et al. ..... 313/642

*Primary Examiner*—Theodore M. Blum
*Assistant Examiner*—Gregory C. Issing
*Attorney, Agent, or Firm*—Oblon, Fisher, Spivak, McClelland & Maier

[57] ABSTRACT

A high-pressure metal vapor arc lamp, lit by direct current power supply, which includes an arc tube in which an anode and a cathode are arranged opposite to one another. The cathode includes a cathode shaft and a coil element wound around the cathode shaft. A diameter of a wire of the coil element is fixed within specific values in connection with a diameter of the cathode shaft, a pitch of the coil is fixed in connection with a diameter of the wire of the coil and $I_L$ (discharge current)/$d_0^2$ (external diameter of the coil) is determined within specific values, whereby an arc spot can be easily moved to the top portion of the cathode even if the arc spot is generated at the base portion of the cathode.

5 Claims, 8 Drawing Figures

HIGH-PRESSURE METAL VAPOR ARC LAMP LIT BY DIRECT CURRENT POWER SUPPLY

BACKGROUND OF THE INVENTION

1. Field of the Invention

The present invention relates in general to high-pressure small metal vapor discharge lamps. More specifically, the invention relates to high-pressure small metal vapor discharge lamps which are lit by a power supply with no polarity alteration such as direct current.

2. Description of the Prior Art

In recent years, in view of energy saving, it has been promoted to develop metal vapor discharge lamps such as, for example, metal halide arc lamps.

Since metal vapor discharge lamps have superior luminous efficiency compared with incandescent lamps, the former tends to be used in place of the latter. These metal vapor discharge lamps are usually lit by the power supply for example A.C. 120 V, 60 Hz. The electric power is fed to metal vapor discharge lamps through a ballast, which is generally installed separated from metal vapor discharge lamps. When considering them as replacements for the incandescent lamps which are mostly used for room lighting in general households and shops, etc., the essential requirements are to incorporated the ballast with the lamp and, furthermore, to make the ballast small, light-weight and low-cost. However, it is difficult to satisfy the conditions for the ballasts in general use which employ choke coils. Recently, through the development of transistors, IC, etc., it has become possible to construct an electronic circuit as a ballast which can satisfy the conditions described above. Although the direct current lighting method and the high-frequency lighting method can be considered as such electronic circuit systems described above, if employing the high-frequency lighting method, the phenomenon called acoustic resonance occurs in particular frequency bands and the arc wavers so that this becomes a cause of extinction of a lamp.

In particular, in the case of metal halide lamps, the high-frequency lighting method is unsuitable since the frequency band in which acoustic resonance occurs is very broad through the influences of the shape of the luminous tube and of the fillers. Therefore, as an electronic ballast for metal halide lamps, a lighting method using direct current power source is particularly desirable.

In the course of development of metal vapor discharge lamps, such as metal halide lamps, which use direct current power source, the inventor discovered that, when discharge lamps which were designed for conventional alternating current lighting use with electrodes having coils wound round the tops of the electrode shafts were lit by direct current power source, there were many lamps which failed to light up because devitrification and cracks occurred in the luminous tube wall in the vicinity of the cathode and so the luminous tube leaked the filler.

Furthermore, it was proved that the phenomenon described above becomes more remarkable with small lamps, such as those of less than 100 W, in which the cathode and the wall of the luminous tube are closer to one another.

The causes of the above-described phenomenon were found when further comparative observation was carried out with lamps for alternating current lighting. When a lamp was lit by direct current power source, arc spot was generated at the seal end of a cathode even if the lamp was stable in the normal condition, and there were times when no arc spot moved to the top of the cathode. It caused the lamps to be cracked in almost all cases if the lamps kept on the state for a long time in the above-described condition.

Conversely, in the case of lighting by alternating current, although the discharge commenced from the seal end of the electrode immediately after starting, in every lamp the arc spot moved to the top of the electrode in a short time and cracks did not occur. It was assumed that this kind of phenomenon was caused by the following factors. That is to say, for both the cases of alternating current and of direct current, since the condition immediately after starting is one of a low pressure of less than 1 atmosphere, the discharge commences in a condition where the discharge distance is longer.

However, as time elapses, the temperature in the luminous tube rises and the pressure in the luminous tube also rises. There is a high pressure of more than 1 atmosphere at the rated lighting. For instance, in the case of metal halide lamps, the pressure rises to about 10 atmospheres or even more. Therefore, in order to maintain a stable discharge, the arc spot moves from the electrode seal end to the top of the electrode, in other words, it moves in a direction which makes the discharge distance d smaller in order to satisfy the well-known law $Pd=const.$ (P is pressure, d is discharge distance). With regard to this phenomenon, in the case of alternating current, since both electrodes repeat the operations of the cathode and the anode in turn each half cycle. When both electrodes act as anode in turn, the tops of the electrode are heated in turn by the arc concentrating on the whole electrode so that the arc easily moves to the top of the individual electrode with the pressure increase. On the contrary, in the case of direct current, the arc becomes a spot at the cathode side and concentrates on only a very limited portion of the electrode. Therefore, only the portion where the arc is concentrated is heated. Moreover, since the coil portion of the electrode acts as a heat radiation fin, even if the pressure in the luminous tube rises, the temperature of the top of the electrode does not rise sufficiently for emitting electrons. Furthermore, since there is no polarity reversal, it is assumed that the movement of the arc from the position where it has once been a spot is not occur unless there is some trigger.

Therefore, when an arc spot occurs at the seal end of the cathode and does not move to the top of the cathode, the high temperature arc has been positioned close to or contact with the inner surface of the luminous tube for a long time, this causes devitrification and cracking of the wall surface of the luminous tube. Furthermore, the fact that the arc spot is generated at the seal end or the top of the cathode in different cases means that the respective arc lengths differ. Therefore, since each lamp voltage differs from one another in correspondence to the difference of the arc distance described above, there is inconvenience that each lamp voltage may be not constant at every lighting.

Japanese Patent Application Ser. No. 123,431 filed July 8, 1983 (Laid open No. 85-17849) in the name of Shinji Inukai and entitled SMALL METAL VAPOR ARC LAMP discloses one of the solutions of the problems described above. As can be seen in FIG. 1, a cathode 1 includes an electrode shaft 2 and a coil 3 which is wound around the top portion of electrode shaft 2 and extends therefrom. A hollow portion 4 is defined within coil 3.

According to the above-described constitution, since the heat capacity of the top portion of coil 3 is small because of hollow portion 4, the temperature of the top portion of coil 3 rises rapidly to the temperature at which electrons are easily emitted. Therefore the arc spot produced on cathode 1 quickly moves to the top of cathode 1 thus preventing devitrification and cracking of the wall surface of the luminous tube. Hollow portion 4, however, causes the arc spot to be fluctuated thus flickering occurs.

Japanese Patent Application Ser. No. 135,174 filed July 26, 1983 (Laid open No. 85-28155) in the names of Shinji Inukai and toshihiko Ishigami and entitled SMALL METAL VAPOR ARC LAMP discloses another solution of the problems. As can be seen in FIG. 2, a bar-shaped element 5, made of high melting-point metal, is inserted into the other side of coil 3. Tops of electrode 2 and bar-shaped element 5 are arranged apart from one another so that a hollow portion 4' is established within coil 3.

This prior art can prevent the fluctuation of an arc spot as well as the devitrification and cracking of the luminous tube. However, since the entire length of coil 3 on cathode 1 of a high-voltage small metal vapor arc lamp is very small, e.g. about 2 mm, it is rather troublesome to provide hollow portion 4' of a prescribed length in such a small coil. There are also disadvantages in yield rate and operations efficiency. These disadvantages cause a manufacturing cost to be increased.

Japanese Patent Application Ser. No. 110,860 filed June 22, 1983 (Laid open No. 85-3846) in the names of Shinji Inukai, Yasuki Mori and Akihiro Inoue and entitled SMALL METAL VAPOR ARC LAMP discloses another solution of the problems. In FIG. 3, cathode 1 is composed of an elongated element made of high melting-point metal such as tungsten. Cathode 1 has no coil. This prior art achieves the same effects as other prior arts described above.

Generally, in discharge phenomena, it is desirable that heat capacity of a portion of an electrode where an arc occurs is as small as possible to accomplish transition from glow to arc smoothly. On the contrary, it is desirable to have a large heat capacity to prevent an electrode from melting accompanying the temperature rise of an electrode, when an arc discharge has occurred. The melting of an electrode concerns a lamp voltage increase related to a lamp life, and an arc extinction.

When a cathode is composed of an elongated element as described above, a lower limiting value of an electrode shaft diameter is determined in view of the prevention of melting of the electrode. An upper limiting value is determined by the boundary point at which transition from glow to arc occurs. Furthermore, even in the area where transition from glow to arc occurs, it is desirable to accomplish the transition smoothly in order to improve lumen maintenance factor as well as to decrease sputtering of an electrode. Further improvement of these points has been desired.

SUMMARY OF THE INVENTION

The object of this invention is to provide an improved high-pressure metal vapor lamp lit by direct current power supply.

Another object of this invention is to provide an improved high-pressure metal vapor lamp constitution in which an arc can be stably maintained between tops of an anode and a cathode in a stable lighting.

To accomplish the above objects, a high-pressure metal vapor lamp includes a luminous tube wherein an anode and a cathode are arranged opposite to one another. The cathode includes a cathode shaft and a coil element which is wound around the surface of the cathode shaft, and the cathode satisfies:

$$0.05 \times d_1 \leqq d_2 \leqq 0.8 \times d_1$$

$$3 \leqq I_L/d_0^2 \leqq 155$$

$$L \leqq 2 \times d_2$$

where $d_0$ (mm) is the outer diameter of the coil, $d_1$ (mm) is the diameter of the cathode shaft, $d_2$ (mm) is the diameter of wire of the coil, L (mm) is a pitch of the coil and $I_L$ (A) is the discharge current when the lamp is being lit.

BRIEF DESCRIPTION OF THE DRAWINGS

The present invention is best understood with reference to accompanying drawings in which.

DETAILED DESCRIPTION OF THE PREFERRED EMBODIMENTS

Figure 4:
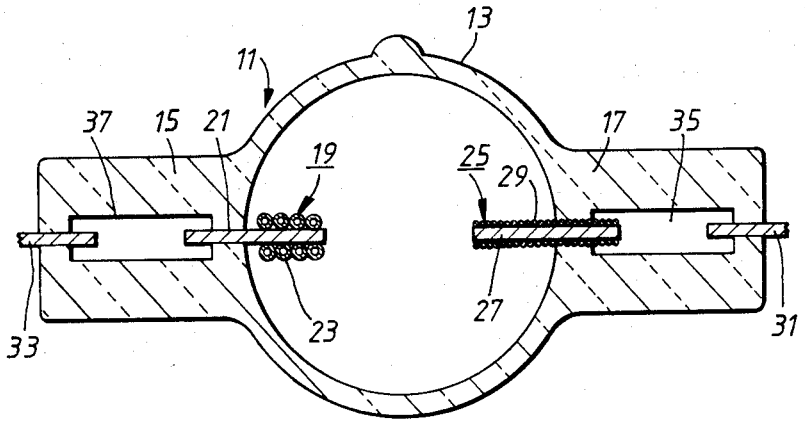
FIG. 4 shows a longitudinal sectional view illustrating a first embodiment of the present invention.

Preferred embodiments of the present invention will be now described in more detail with reference to the accompanying drawings. FIG. 4 shows an arc tube of a first embodiment of a small metal halide arc lamp (40 W class) embodying the invention. An arc tube 11 includes a hollow light-emitting portion 13 containing a fill of a proper amount of starting rare gas, such as argon of 100 (Torr), mercury of 10 (mg) and metal halide materials, e.g. NaI and $ScI_3$ of 2 (mg) in total.

Hollow light-emitting portion 13 is formed in spherical shape and the maximum internal diameter thereof is 8 (mm). A first squeezed portion 15 is formed at one side of hollow light-emitting portion 13. A second squeezed portion 17 is formed at the side opposite to one side of hollow light-emitting portion 13. An anode 19 is arranged at first squeezed portion 15. Anode 19 includes an anode shaft 21, made of tungsten whose diameter is 0.22 (mm), one end of which is supported by first squeezed portion 15 and the other end projects from first squeezed portion 15 into hollow light-emitting portion 13. The projection length of the other end of anode shaft 21 is set to 2 (mm). A double coil 23 is formed that it includes a tungsten core wire whose diameter is set to 0.18 (mm) and a tungsten wire of 0.06 (mm) diameter which is coarsely wound around the tungsten core wire, and it is densely wound around the other end of anode shaft 21. The external diameter of double coil is set to 0.82 (mm) and the winding length thereof is set to 1.5 (mm).

A cathode 25 is arranged at second squeezed portion 17. Cathode 15 includes a cathode shaft 27, made of a high melting-point metal such as tungsten, whose diameter $d_1$ is set to 0.1 (mm). One end of cathode shaft 27 is supported by second squeezed portion 17 and the other end projects from second squeezed portion 17 into hollow light-emitting portion 13. The projection length of the other end of cathode shaft 27 is fixed to 2 (mm). A coil 29 is wound around cathode shaft 27 as described hereafter. The one ends of cathode shaft 27 and anode shaft 21 are connected to individual lead wires 31 and 33 through respective metal foils 35 and 37 such as molybdenum within respective squeezed portions 15 and 17. As can be seen in more detail in FIG. 5, coil 29 is formed that it includes tungsten wire 39 whose diameter $d_2$ is set to 0.05 (mm) and is densely wound around cathode shaft 27 from one end of cathode shaft 27 to the other end thereof. Therefore, the outer diameter $d_0$ of coil 29 is set to 0.2 (mm). Furthermore, since coil 29 is densely wound around cathode shaft 27, the pitch L thereof, the distance between centers of wire 39 adjoining to one another, is equal to the diameter $d_2$ of wire 39, i.e. 0.05 (mm).

Normally, arc tube 11 is enclosed in an external tube (not illustrated in FIGURES) to be used as a lamp.

Figure 6:
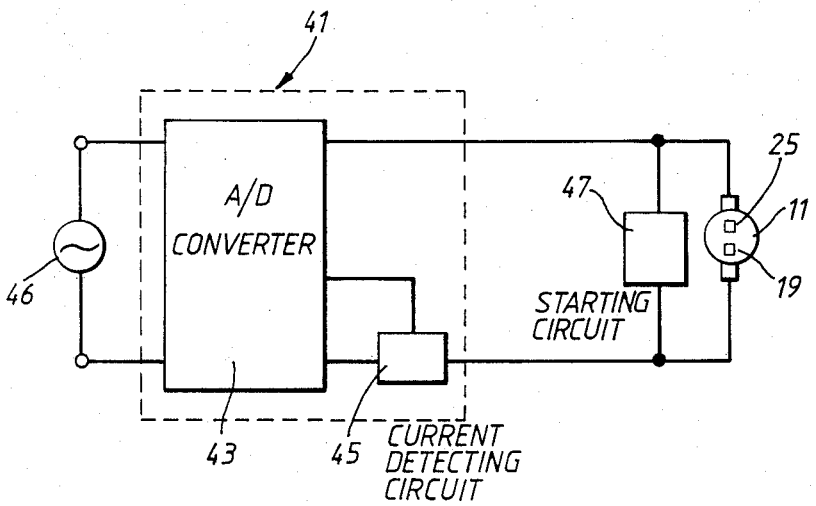
FIG. 6 shows a circuit diagram of a lighting circuit used in one embodiment.

As shown in FIG. 6, arc tube 11 with the constitution described above is energized by a direct current electronic lighting ballast 41 (hereafter refer to as a lighting ballast). Lighting ballast 41 includes an AC/DC converter 43 which converts alternating current to direct current and a current detecting circuit 45.

Cathode 25 of arc tube 11 is connected to one of the terminals of A.C. power supply 46 through AC/DC converter 43 and Anode 19 thereof is connected to the other terminal of A.C. power supply 46 through current detecting circuit 45 and AC/DC converter 43. A starting circuit 47 is connected between anode 19 and cathode 25 to feed a starting pulse voltage to the both electrodes. When arc tube 11 is being lit, a discharge current $I_L$ of 0.56 (A) is fed to arc tube 11 by lighting ballast 43 and starting circuit 47, and a lamp input is controlled to 40 (W). Consequently, the current density of cross-section of cathode 25 with coil 29 whose external diameter $d_0$ is 0.2 (mm) is $I_L/d_0^2 = 0.56\ (A)/(0.2\ (mm))^2 \simeq 14$.

When 100 times on and off test was individually carried out to 10 lamps with the above-described constitution, it was observed that there was no phenomenon in which an arc was produced at the base portion of a cathode in a stable lighting condition. The reason for this observation is as follows. Cathode 25 of this embodiment has thinner cathode shaft 27 compared with a conventional cathode shaft and coil 29 including wire 39 whose diameter $d_2$ is as thin as 0.5 times of the diameter $d_1$ of cathode shaft 27. Furthermore, coil 29 is wound around cathode shaft 27 from the top portion of cathode shaft 27 to the end portion at which cathode shaft 27 is connected to metal foil 35. Therefore, since there is no larger coil portion as conventional cathode which has a large heat capacity and causes heat radiation, temperature at top portion of cathode 25 rapidly rises to the temperature at which an arc is easy to be generated. If an arc is generated at the base portion of cathode 25 which stands near the inner surface of arc tube 11, since the metals sealed in light-emitting portion 13 of arc tube 11 vapors and the vapor pressure in light-emitting portion 13 rises as it advances to the stable lighting condition, the arc shifts the top portion of cathode 25 to cause an arc-length between cathode 25 and anode 19 to be minimized. After that, the arc has been maintained between the top portions of anode 19 and cathode 25.

Figure 3:
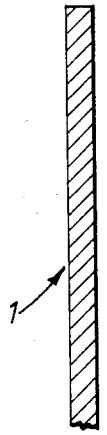
PRIOR ART FIG. 3.
FIG. 3 also shows a side view illustrating a cathode of still another prior art.

According to the above-described constitution, since quartz glass of arc tube 11 is not heated excessively, devitrification and crack of quartz glass of arc tube 11 are prevented. Furthermore, since no arc-length change is occurred at every lighting, it can solve the problem of lamp voltage changes. After 1,000 hours lighting, a good result of the lumen maintenance of 85% was obtained in the arc tube with above-described constitution. The above-result comes from the following reason. The constitution of cathode 25 in this embodiment is different from the prior art as shown in FIG. 3, because cathode 25 includes cathode shaft 27 and coil 29 which is wound around cathode shaft 27. Therefore, a glow voltage of arc tube 11 decreases and transition from glow to arc becomes good so that sputtering of cathode shaft 27 decreases.

In order to obtain suitable ranges for cathode constitution, tests were carried out on influence upon lamp characters by varying the constitution of cathode of a 40 W metal halide lamp which was the same as that of the above-described embodiment. TABLE 1 shows the result and the evaluation of the tests.

TABLE 1

$I_L$ = 0.56 (A)

| | TEST NO. | EXTERNAL DIAMETER OF COIL $d_1$ (mm) | DIAMETER OF CATHODE SHAFT $d_1$ (mm) | DIAMETER OF WIRE OF COIL $d_2$ (mm) | PITCH OF COIL L (mm) | $d_2/d_1$ | $I_L/d_0^2$ | $L/d_2$ | LUMEN MAINTENANCE FACTOR (%) | TRANSITION OF ARC | EVALUATION |
|---|---|---|---|---|---|---|---|---|---|---|---|
| FIRST GROUP | 1 | 0.50 | 0.25 | 0.125 | 0.125 | 0.5 | 1.0 | 1 | — | Δ | x |
| | 2 | 0.48 | 0.24 | 0.12 | 0.12 | 0.5 | 2.4 | 1 | 72 | o | Δ |
| | 3 | 0.43 | 0.22 | 0.105 | 0.105 | 0.48 | 3.0 | 1 | 80 | o | o |
| | 4 | 0.35 | 0.18 | 0.085 | 0.085 | 0.47 | 4.6 | 1 | 83 | o | o |
| | 5 | 0.30 | 0.15 | 0.075 | 0.075 | 0.5 | 6.2 | 1 | 85 | o | o |
| | 6 | 0.20 | 0.10 | 0.05 | 0.05 | 0.5 | 14.0 | 1 | 85 | o | o |
| | 7 | 0.10 | 0.05 | 0.025 | 0.025 | 0.5 | 56.0 | 1 | 83 | o | o |
| | 8 | 0.06 | 0.03 | 0.015 | 0.015 | 0.5 | 155.6 | 1 | 79 | o | o |
| | 9 | 0.04 | 0.02 | 0.01 | 0.01 | 0.5 | 350 | 1 | 50 | o | x |
| SECOND GROUP | 10 | 0.40 | 0.1 | 0.15 | 0.15 | 1.5 | 3.5 | 1 | 60 | o | x |
| | 11 | 0.42 | 0.14 | 0.14 | 0.14 | 1 | 3.2 | 1 | 70 | o | Δ |
| | 12 | 0.39 | 0.15 | 0.12 | 0.12 | 0.8 | 3.7 | 1 | 80 | o | o |

TABLE 1-continued $I_L = 0.56$ (A)

| | TEST NO. | EXTERNAL DIAMETER OF COIL $d_1$ (mm) | DIAMETER OF CATHODE SHAFT $d_1$ (mm) | DIAMETER OF WIRE OF COIL $d_2$ (mm) | PITCH OF COIL L (mm) | $d_2/d_1$ | $I_L/d_0^2$ | $L/d_2$ | LUMEN MAINTE-NANCE FACTOR (%) | TRANSI-TION OF ARC | EVALU-ATION |
|---|---|---|---|---|---|---|---|---|---|---|---|
| | 13 | 0.38 | 0.18 | 0.10 | 0.10 | 0.56 | 3.9 | 1 | 82 | o | o |
| | 14 | 0.39 | 0.26 | 0.065 | 0.065 | 0.25 | 3.7 | 1 | 81 | o | o |
| | 15 | 0.42 | 0.35 | 0.035 | 0.035 | 0.1 | 3.2 | 1 | 79 | o | o |
| THIRD GROUP | 7 | 0.1 | 0.05 | 0.025 | 0.025 | 0.5 | 56.0 | 1 | 83 | o | o |
| | 16 | 0.1 | 0.05 | 0.025 | 0.038 | 0.5 | 56.0 | 1.5 | 82 | o | o |
| | 17 | 0.1 | 0.05 | 0.025 | 0.05 | 0.5 | 56.0 | 2 | 82 | o | o |
| | 18 | 0.1 | 0.05 | 0.025 | 0.075 | 0.5 | 56.0 | 3 | 74 | o | Δ |
| | 19 | 0.1 | 0.05 | 0.025 | 0.10 | 0.5 | 56.0 | 4 | 65 | o | x |

An external diameter $d_0$ (mm) of a coil (diameter of a cathode), a diameter d(mm) of a cathode shaft, a diameter $d_2$ (mm) of a wire of the coil and a pitch L (mm) of the coil were selected as variation factor. In lamp characteristics, (a) lumen maintenance based on difficulty of transition from glow to arc and (b) difficulty of a shift of an arc spot from a base portion of a cathode to a top portion thereof causing devitrification and crack of an arc tube were selected. Evaluation was carried out on the basis of the above-described characters (a) and (b). The total sample amount of each test is 10.

(A). In a first group (test Nos. 1 to 9) in TABLE 1, the external diameter $d_0$ of a coil (external diameter of a cathode) was varied under such conditions that the relationship between the diameter $d_1$ of a cathode shaft and the diameter $d_2$ of a wire of a coil was fixed as $d_2/d_1-0.5$ and the relationship between a pitch L of the coil and the diameter $d_2$ of the wire of the coil is fixed as $1/d_2=1$, that is to say, the coil was densely wound around the cathode shaft. As a result of the tests, in the test No. 1 where $d_0$ is 0.05 (mm), transition from glow to arc took more than one minute in seven of ten samples. In two of the remaining three samples, transition to arc was not accomplished so that normal lighting was not achieved. It is presumed that the external diameter $d_0$ of the coil is too large compared with a lamp current $I_L$ in stable lighting.

In the test No. 2 where $d_0$ is 0.48 (mm), though transition from glow to arc was accomplished within one minute in all samples, transition to arc was not completed smoothly compared with the coil which has a smaller external diameter $d_0$. Since lumen maintenance factor was 72% in this test after 1,000 hours lighting, no desirable lumen maintenance factor was obtained.

In the test No. 9 in which $d_0$ is 0.04 (mm), since the external diameter $d_0$ of the coil was too small, the top portion of the cathode was melted excessibly. The lumen maintenance factor, therefore, was bad at 50%. As can be understood from TABLE 1, a desirable range of the external diameter $d_0$ of the coil is from 0.06 (mm) (No. 8) to 0.43 (mm) (No. 3). Within this range, arc shifting from the base portion of the cathode to the top portion thereof was completed smoothly. In the meantime, transition from glow to arc and sputtering of a cathode caused by transition are under the influence of discharge current $I_L$ (A) which flows into a cathode during stable lighting as well as size of an external diameter $d_0$ of a coil (external diameter of a cathode). When the relationship between above-described discharge current $I_L$ (0.56 (A)) and a desirable coil external diameter $d_0$ (0.06 (mm) to 0.43 (mm)), i.e. external diameter of cathode made of high melting-point metal such as tungsten, is expressed by a general expression as $I_L/d_0^2$.

The upper and lower limiting values of the expression described above are as follows:

the upper limiting value $0.56/0.06^2=155$ the lower limiting value $0.56/0.43^2=3$ As can be understood from the above-described expressions, discharge current $I_L$ and the external diameter $d_o$ of a coil (external diameter of a cathode) should satisfy the following Equation without being dependent on an input of lamp (W):

$$3 \leqq I_L/d_0^2 \leqq 155 \quad (1)$$

Figure 7:
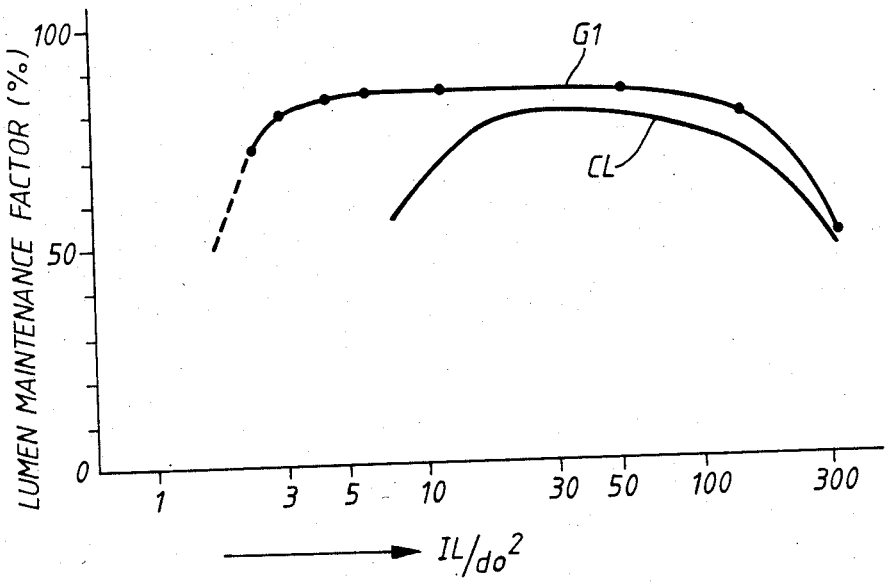
FIG. 7 shows a graph of the characteristic comparison between conventional lamp shown in FIG. 3 and one embodiment shown in FIG. 4.

FIG. 7 is a characteristic comparison diagram between lamps of first group (G1) and conventional lamps (CL) shown in FIG. 3. In FIG. 7, the axis of ordinate indicates lumen maintenace factor after 1,000 hours lighting and the axis of abscissa indicates $I_L/d_0^2$. As can be seen in FIG. 7, lumen maintenance factor of each lamp of first group is improved in comparison with the conventional lamps at the same value of $I_L/d_0^2$. A tendency toward improvement of lumen maintenance factor is remarkable as $I_L/d_0^2$ becomes small, that is, in the region where $d_o$ is large. However, when $d_o$ is too large, lumen maintenance factor decreases rapidly.

(B). In a second group (test Nos. 10 to 15) in TABLE 1, the tests were carried out with regard to the relationship between a diameter $d_2$ of wire of a coil and a diameter $d_1$ of a cathode shaft.

In this test, since it was understood from the result of the test of first group described above that lumen maintenance factor became worse when the external diameter $d_0$ of a coil (external diameter of cathode) was too large, observation was carried out with regard to the relationship between the diameter $d_2$ of wire of the coil and the diameter $d_1$ of a cathode shaft under the similar value of $d_0$ which was fixed at the value of the vicinity of 0.4 mm close to its upper limited value. A coil was densely wound around a cathode shaft, i.e. $L/d_2=1$.

In result, an undesirable influence was appeared in transition from glow to arc in sample Nos. 10 and 11 in which $d_2/d_1$ was more than one. Therefore, the total evaluations of sample Nos. 10 and 11 were poor X and slightly poor Δ, though shifting of arc from the base portion of a cathode to the top portion thereof was good. In sample Nos. 12 to 15 in which $d_2/d_1$ is less than 0.8, both lumen maintenance factor and shifting of arc were good. It should be noted that if $d_2/d_1$ is less than 0.05, it is similar to the cathode which is made of only elongated metal as the prior art shown in FIG. 3.

As can be understood from the above discussion, a desirable relationship between $d_2$ and $d_1$ is as follows:

$$0.05 \times d_1 \leqq d_2 \leqq 0.8 \times d_1 \quad (2)$$

With the result that similar test was carried out in relationship between $d_2$ and $d_1$ in case where $d_0$ was set to a value other than 0.4 (mm) and satisfied the Equation (1), desirable results were achieved for lumen maintenance factor and transition of arc, if the values of $d_1$ and $d_2$ are set to satisfy the Equation (2).

(C). A third group (test Nos. 16 to 19 and 7) in TABLE 1 shows the result of the tests in the pitch L of a coil wound around the cathode shaft of the cathode which satisfied both the Equations (1) and (2).

If a coil pitch L is wider, melting of a top portion of a cathode is occurred when a diameter $d_1$ of an electrode shaft is small. Accordingly, data of the No. 7 in first group were selected as a standard. Because in first group, the external diameter $d_0$ of a coil (external diameter of a cathode) of test No. 7 is the smallest in test samples which satisfy the Equation (1) and both the diameters $d_1$ and $d_2$ of the cathode shaft and the wire of the coil in test No. 7 are fairly small. The tests were carried out by varying the value of a coil pitch L in test No. 7 in first group.

As can be seen in TABLE 1, in third group, the top portions of cathodes of Nos. 18 and 19 in which each value of $L/d_2$ is more than 3 and each value of coil pitch L is rather wide were strongly melted. The lumen maintenance factors of test Nos. 18 and 19 were slightly poor Δ and poor X respectively. In test Nos. 7, 16 and 17 in which each value of $L/d_2$ is less than 2, melting of the top portion of each cathode hardly occurred. Furthermore, lumen maintenance factor and shifting of an arc spot from the cathode base portion to the cathode top portion were both good in respective test.

As a matter of course, if individual values of $d_0$, $d_1$ and $d_2$ are larger within the range where each value of $d_0$, $d_1$ and $d_2$ satisfies the Equation (1), it becomes more difficult to take place melting of the top portion of a cathode. Therefore, the relationship between a coil pitch L and a diameter $d_2$ of a coil wire should satisfy the following expression:

$$L \leqq 2 \times d_2 \quad (3)$$

As can be understood from the discussion described above, if the constitution of a cathode is designed to satisfy all the Equations (1), (2) and (3), no devitrification or leak in an arc tube occurs and lumen maintenance factor can be improved even if the arc tube is energized by the power supply with no polarity alteration, such as direct current. In addition, in the stable lighting, since an arc spot is securely formed to the top portion of a cathode, no changing of an arc length occurs so that fluctuations of a lamp voltage become less.

Figure 1:
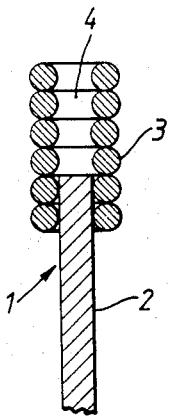
PRIOR ART FIG. 1.
FIG. 1 shows a side view illustrating a cathode of one prior art of the present invention.
Figure 2:
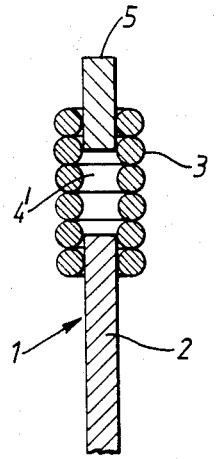
PRIOR ART FIG. 2.
FIG. 2 shows a side view illustrating a cathode of another prior art.
Figure 5:
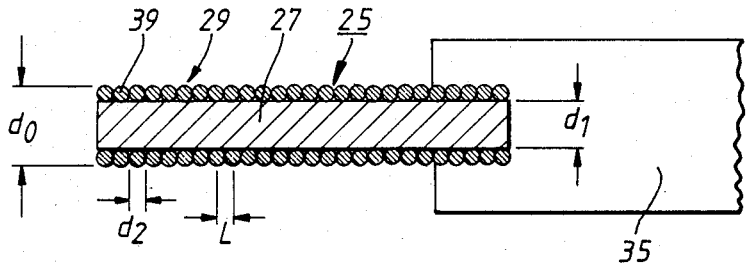
FIG. 5 shows an enlarged sectional view illustrating a cathode shown in FIG. 4.

According to the above-described embodiment, since the constitution of the cathode as shown in FIG. 5 differs from the conventional cathode as shown in FIG. 1 in which cathode 1 has coil 3 with hollow portion 4 at the top portion of cathode shaft 2, there is no flickering based on the moving of an arc spot. Furthermore, there is nothing to do troublesome operations in which hollow portion 4' with a prescribed length is formed inside extremely small coil 3 as shown in FIG. 2. In the cathode as shown in FIG. 5 in which coil 29 is wound around the entire length of cathode shaft 27, the cathode can be obtained by the process that a coil is wound around a tungsten wire which becomes a cathode shaft hereupon the tungsten wire is cut at a prescribed length. Above-described process has advantages of an excellent processability and a desirable cost.

Similar tests and considerations to the 40 W lamp test described above were carried out in connection with a 100 W metal halide lamp including an anode and cathode, the top portions of which are arranged in an arc tube at intervals of 20 (mm) therebetween. In this test, there were used a D.C. lighting ballast in which a discharge current $I_L$ was 1 (A) in stable lighting and a lamp input was 100 (w). It was confirmed that similar results to the 40 W lamp test were also achieved in this tests when samples of this tests satisfied Equations (1), (2) and (3) described above.

It should be noted that the top portion of a cathode may project from a one end of a coil within the degree of a diameter $d_1$ of the cathode without being wound the coil on the entire length thereof.

Figure 8:
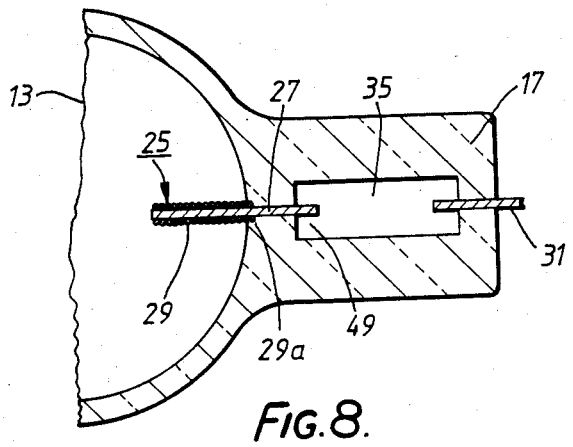
FIG. 8 shows a sectional view illustrating an essential part of a second embodiment.

As shown in FIG. 8, since it is not necessary to wind coil 29 to the connecting point 49 between cathode shaft 27 and metal foil 35, the other end 29a of coil 29 may exist at least in second squeezed portion 17.

According to the above-described embodiments, since an arc spot can easily move to the top portion of a cathode even if the arc spot has been developed on the base portion of the cathode when a lamp is lighted by a power supply with no polarity alteration such as direct current, no arc with high temperature has existed close to an inner wall of an arc tube during long hours so that occurrence of devitrification or crack to the inner wall of an arc tube can be prevented. Since a constant arc length can be achieved by forming an arc between the top portions of an anode and cathode in a stable lighting, an lamp voltage fluctuation can be minimized. Furthermore, since transition from glow to arc is easily accomplished, it can be achieved an improvement in lumen maintenance factor as well as a decrease in sputtering of a cathode.

The present invention has been described with respect to a specific embodiments. However, other embodiments such as high-pressure mercury lamps, high-pressure natrium lamps etc. based on the principles of the present invention should occur to those of ordinary skill in the art. Such embodiments are intended to be covered by the claims.

What is claimed is:

1. A high-pressure metal vapor arc lamp lit by power supply with no polarity alteration comprising:

an arc tube containing a fill including starting rare gases and at least mercury, said arc tube including:
- a hollow light-emitting portion,
- a first squeezed portion formed at one end of said hollow light-emitting portion, and
- a second squeezed portion formed at the other end of said hollow light-emitting portion, an anode including anode shaft, one end of which is supported by said first squeezed portion, the other end of which extends into said hollow light-emitting portion of said arc tube; and a cathode which includes a cathode shaft, one end of which is supported by said second squeezed portion, the other end of which extends into said hollow light-emitting portion of said arc tube, and a coil wound around the outer surface of said cathode shaft, said cathode satisfies:

$$0.05 \times d_1 \leqq d_2 \leqq 0.8 \times d_1$$

$$3 \leqq I_L/d_0^2 \leqq 155$$

$L \leqq 2 \times d_2$ where $d_0$ (mm) is the external diameter of said coil, $d_1$ (mm) is the diameter of said cathode shaft, $d_2$ (mm) is the diameter of a wire of said coil, L (mm) is a pitch of said coil and $I_L$ (A) is a discharge current when said lamp is being stably lit.

2. The high-pressure metal vapor arc lamp according to claim 1, further including a metal foil element, which is sealed in said second squeezed portion, one end of which is connected to the one end of said cathode shaft.

3. The high-pressure metal vapor arc lamp according to claim 2, wherein said coil is wound around said cathode shaft substantially from the top portion of said cathode shaft to the portion at which said cathode shaft is supported by said second squeezed portion of said arc tube.

4. The high-pressure metal vapor arc lamp according to claim 3, wherein said coil is wound around said cathode shaft to the connecting point between said cathode shaft and said metal foil element in said second squeezed portion of said arc tube.

5. The high-pressure metal vapor arc lamp according to claim 1, wherein a distance between the top portions of said anode shaft and cathode shaft is less than 20 (mm).

* * * * *